United States Patent [19]

Martin

[11] 4,118,897

[45] Oct. 10, 1978

[54] BELT-TYPE SANDER ACCESSORY

[76] Inventor: Ronald Martin, 5225 SW. Lakeview Blvd., Lake Oswego, Oreg. 97034

[21] Appl. No.: 722,537

[22] Filed: Sep. 13, 1976

Related U.S. Application Data

[63] Continuation-in-part of Ser. No. 634,192, Nov. 21, 1975, Pat. No. 3,983,664.

[51] Int. Cl.[2] ..... B24B 23/06

[52] U.S. Cl. ..... 51/170 EB

[58] Field of Search ..... 51/170 EB; 145/4, 4.1

[56] References Cited

U.S. PATENT DOCUMENTS

| | | | |
|---|---|---|---|
| 1,452,493 | 4/1923 | Commer | 145/4.1 |
| 2,044,982 | 6/1936 | Hedgpeth | 51/170 EB |
| 2,483;720 | 10/1949 | Asbury | 51/170 EB |
| 2,742,741 | 4/1956 | Frostade | 51/170 EB |
| 3,029,568 | 4/1962 | Lubas | 51/170 EB |
| 3,049,842 | 8/1962 | Murschel | 51/170 EB |
| 3,176,436 | 4/1965 | Anton | 51/170 EB |
| 3,325,948 | 6/1967 | Gronke | 51/170 R |
| 3,983,664 | 10/1976 | Martin | 51/170 EB |

*Primary Examiner*—Harold D. Whitehead
*Assistant Examiner*—Roscoe V. Parker
*Attorney, Agent, or Firm*—Chernoff & Vilhauer

[57] ABSTRACT

A belt-type sander accessory adapted for operative attachment to a portable hand-held power drill. The sander accessory comprises an elongate body member open at its bottom and at one side, a drive roller and an idler roller mounted in the body member proximate opposite ends thereof, and a bearing plate assembly mounted in the body member between the two rollers; the rollers and the bearing plate assembly being oriented within the body member such that an endless belt of sandpaper may be looped around the two rollers with a portion of its length in contact with an outwardly facing bearing surface forming a part of the bearing plate assembly. The driver roller is journaled to the body member directly and the idler roller is journaled to a yoke assembly that is in turn mounted on the bearing plate assembly. Means are provided for operably coupling the drive roller to a hand-held power drill so as to permit operation of the sander by operation of the drill. A unique fulcrumnal arrangement is employed between the yoke assembly and the bearing plate assembly to permit angular adjustment, automatic tensioning and quick-release positioning of the idler roller relative to the drive roller, as well as to permit ready disassembly for repair and maintenance. The bearing plate assembly itself is of rigid box-like construction to enhance the strength characteristics of the device which is preferably made of lightweight plastic. Laterally extending pads mounted on the body member are provided to prevent gouging and uneven sanding of a workpiece during operation of the sander accessory.

6 Claims, 11 Drawing Figures

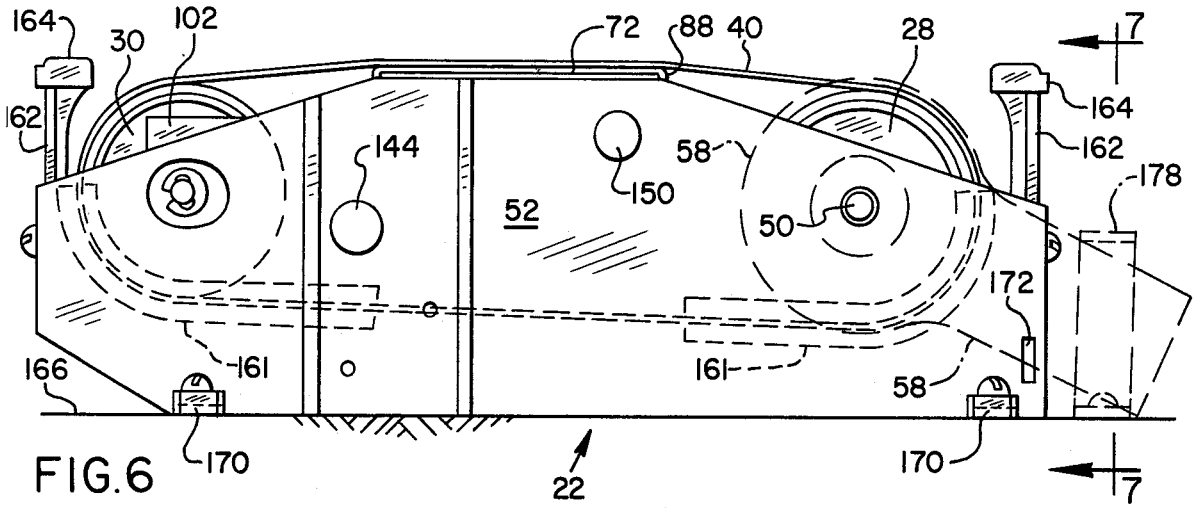
FIG.6
FIG.8
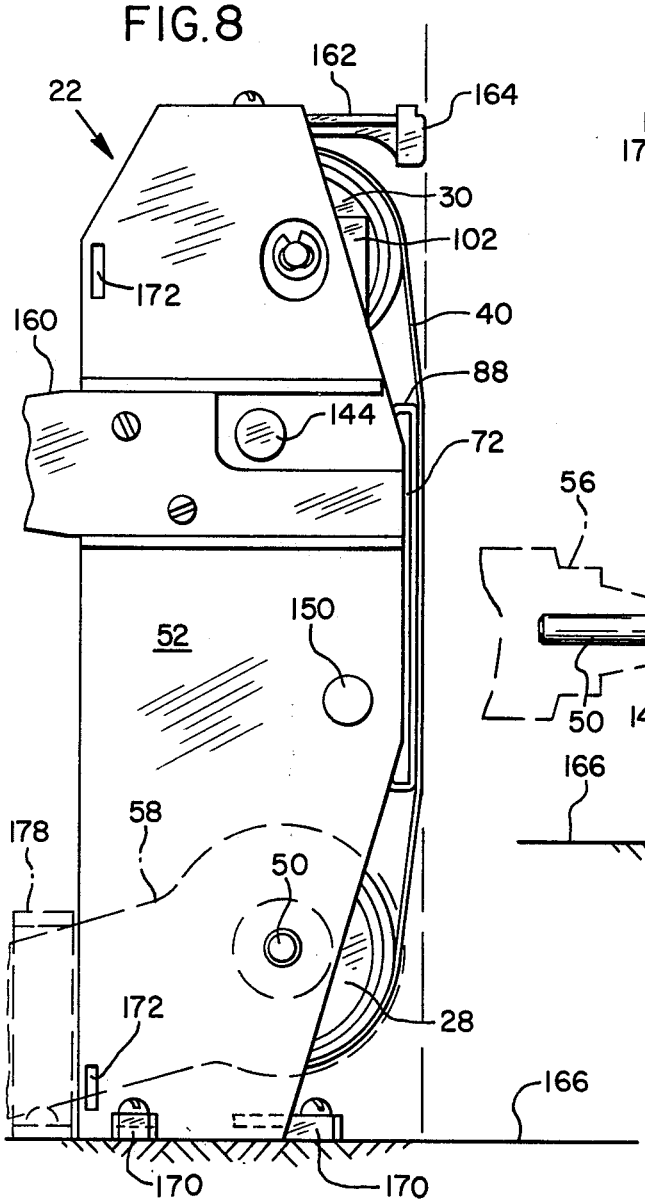
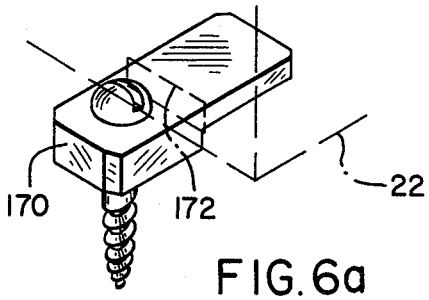
FIG.6a
FIG.7
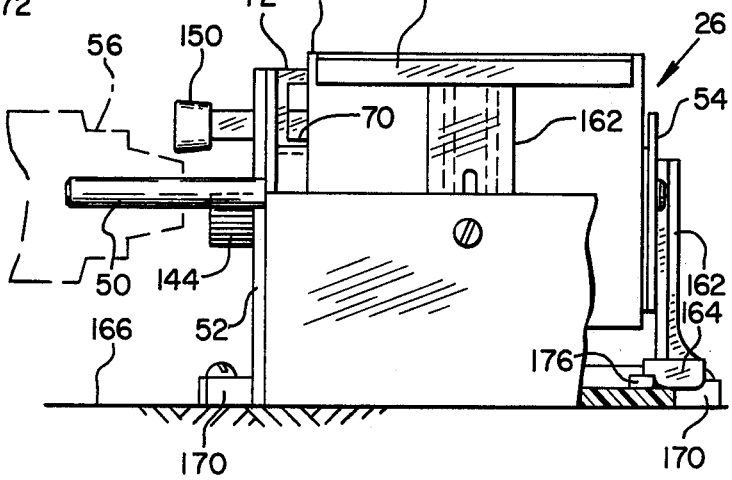

BELT-TYPE SANDER ACCESSORY

CROSS-REFERENCE TO RELATED APPLICATIONS

This is a continuation-in-part of my application Ser. No. 634,192, filed Nov. 21, 1975 and now Pat. No. 3,983,664 which is incorporated herein by this reference.

BACKGROUND OF THE INVENTION

The present invention relates to a portable belt-type sander and especially to such a sander adapted for operative attachment as an accessory to a hand-held electric power drill. Examples of such sander accessories include those disclosed by Werth U.S. Pat. No. 2,819,565, Ruehle U.S. Pat. No. 2,538,044 and Asbury U.S. Pat. No. 2,483,720. Other prior art patents relevant to portable sanders in general include the following U.S. Pat. Nos.:

Beckering et al. — 3,566,548
Beckering et al. — 3,474,575
Beckering — 3,429,078
Beckering et al. — 3,393,573
Foell, Jr., et al. — 3,362,111
McCarty et al. — 3,359,689
Blevins — 3,312,116
Anton — 3,176,436
Lubas — 3,029,568
Bruck — 2,893,176
Frostade — 2,742,741
Moore — 2,686,392
Parker — 2,272,273
Myers — 2,069,502
Myers — 2,000,784
Myers — 1,969,318
Pepys-Goodchild — U.K. Pat. No. 16,756
Scheer — German Pat. No. 602,436

SUMMARY OF THE INVENTION

The present invention is directed to certain improvements in a belt-type sander accessory, such as disclosed in my earlier application Ser. No. 634,192 incorporated herein by reference above, for use with an electric powered portable hand drill. More particularly, the sander accessory of the present invention includes an elongate body member open at its bottom and at one side, a pair of cylindrical rollers mounted therein in spaced parallel relationship, one of the rollers serving as a drive roller and the other as an idler roller, and a bearing plate assembly mounted in the body member between the two rollers such that an endless belt of sandpaper may be looped around the two rollers with a portion of its length in contact with an outwardly facing bearing surface forming a part of the bearing plate assembly and extending across the open bottom of the body member. The drive roller is fixed to an axle that is journaled directly to the body member so as to extend from a selected side thereof a distance sufficient to permit its operable engagement by the chuck of a hand-held power drill. The idler roller is rotatably mounted on one end of a unique yoke assembly that is mounted on the bearing plate assembly in a manner permitting the idler roller to be adjusted both laterally and angularly with respect to the drive roller. A novel fulcrum-type engagement is employed between the yoke assembly and the bearing plate assembly to permit the aforesaid angular adjustment of the idler roller and also, in conjunction with a pair of bias springs connected between the yoke assembly and the bearing plate assembly, to permit automatic tensioning of the sandpaper belt looped around the two rollers as well as manual detensioning of the belt to facilitate its ready removal and replacement. Adjustable restraining means coupling the yoke assembly to one side of the body member provide selective adjustment of the angular relationship between the idler roller and the drive roller. Adjustable skids are attached to the end of the body member to prevent the sander accessory, during operation, from gouging or otherwise unevenly sanding a workpiece as the sander is moved thereacross.

Where possible, the components of the sander accessory are formed of lightweight plastic material to minimize both weight and expense. Gussets and metal reinforcements are employed where necessary to provide the requisite strength and resistance to wear.

The bearing plate assembly of the sander accessory comprises upper and lower plate members attached to one another in spaced parallel relationship to form a rigid box-like structure connected along one edge to the closed side of the body member so as to extend laterally across the open bottom thereof. A metal shoe having a substantially planar bearing surface mounts on the lower plate member of the bearing plate assembly to provide a supportive backing for the portion of the sanding belt in contact therewith. This shoe is displaceable laterally from the bearing plate assembly as desired to permit operation of the sander near the inside corner of two orthogonally oriented workpieces.

The yoke assembly of the sander accessory includes a shank portion disposed longitudinally in the body member and having a forward section on which the idler roller is mounted and a detachable rearward section adapted to be seated in a notch formed in an edge of the upper plate member of the bearing plate assembly. A semicircular bearing surface formed within the rearward section of the yoke assembly is maintained in contact with the inner edge of the notch in the bearing plate assembly by one of the two aforementioned bias springs to produce a novel fulcrum-like engagement between the yoke assembly and bearing plate assembly, thereby permitting the desired angular movement between the two assemblies. Both sections of the yoke assembly have laterally extending slots formed therein for engaging, when the two sections are intercoupled, the upper plate member of the bearing plate assembly to facilitate the angular movement of the yoke assembly while at the same time preventing significant vertical movement. The slots also permit the entire yoke assembly to be displaced rearwardly a distance sufficient to disengage the rear section of the shank from the notch in the upper plate member of the bearing plate assembly, thereby detensioning the sandpaper belt looped around the two rollers and facilitating its ready mounting and dismounting. A rod member coupled to the rearward section of the yoke assembly and extending through the closed side of the body member facilitates the re-engagement of the section with the notch in the bearing plate assembly, and the attendant retensioning of the sandpaper belt, once a new belt has been mounted.

The two bias springs coupling the yoke assembly to the bearing plate assembly operate in cooperation to (1) hold the rear section of the yoke assembly in seated fulcrumnal engagement with the notch in the upper plate member of the bearing plate assembly, (2) produce a force urging the forward section and the idler roller laterally away from the closed side of the body member and toward the open side, and (3) hold the two portions of the yoke assembly in coupling engagement with each other and with the bearing plate assembly. Adjustable restraining means are provided for limiting the movement of the idler roller away from the closed side of the body member and for permitting minute adjustment of the angular displacement of the idler roller with respect to the drive roller.

For operation, with the chuck of a portable handheld power drill coupled to the drive roller axle extending from one side of the body member so as to produce rotation of the drive roller upon operation of the drill, the sander accessory is held in one hand by means of a handle attached to the body member, and the drill is held in the other hand. The sander accessory and drill combination are then moved across a workpiece in a manner similar to that for conventional belt-type sanders. Laterally extending skids mounted at either end of the sander accessory and extending downwardly a distance level with the bearing surface of the bearing plate assembly provide pitch and roll stability for the sanding accessory and prevent uneven sanding of the workpiece.

For use as a bench-mounted sander, mounting tabs are provided to facilitate mounting the body member on a work surface with the bearing surface of the bearing plate assembly oriented in either a horizontal or vertical position. When the sander is so mounted, the power drill coupled to the axle of the drive roller is also mounted to the work surface by a strap or other suitable means and operation of the sander is again accomplished by operation of the drill. Means are provided for attaching one of the laterally extending skids normally mounted at the ends of the body member to the open side of the body member to provide additional support for the bearing plate assembly when the sander accessory is mounted on the work surface in a horizontal position.

It is, therefore, a principal objective of the present invention to provide an improved lightweight belt-type sander attachment for use as an accessory to a hand-held portable power drill.

It is an additional objective of the present invention to provide a belt-type sander accessory of the type described having a yoke assembly in fulcrumnal engagement with an associated bearing plate assembly for permitting angular adjustment and lateral displacement of an idler roller mounted thereon.

It is a further objective of the present invention to provide a sander accessory of the type described having a bearing plate assembly of rigid box-like configuration to provide firm backing support for a portion of an endless sandpaper belt extending thereacross.

It is a still further objective of the present invention to provide a belt-type sander accessory of the type described having laterally extending skids mounted at either end of its body member to provide both pitch and roll control of the sander accessory during operation.

The foregoing objectives, features and advantages of the present invention will be more readily understood upon consideration of the following detailed description of the invention taken in conjunction with the accompanying drawings.

BRIEF DESCRIPTION OF THE DRAWINGS

FIG. 6 is a side elevation of the sander accessory of the present invention mounted in a horizontal position atop a work surface.

FIG. 6*a* is a detail view of a mounting tab employed to mount the sander accessory of FIG. 6 to a work surface.

FIG. 7 is a partially cutaway end view of the sander accessory mounted as in FIG. 6.

FIG. 8 is an elevation view of the sander accessory of the present invention mounted in a vertical position atop a work surface.

DETAILED DESCRIPTION OF THE PREFERRED EMBODIMENT

Figure 1:
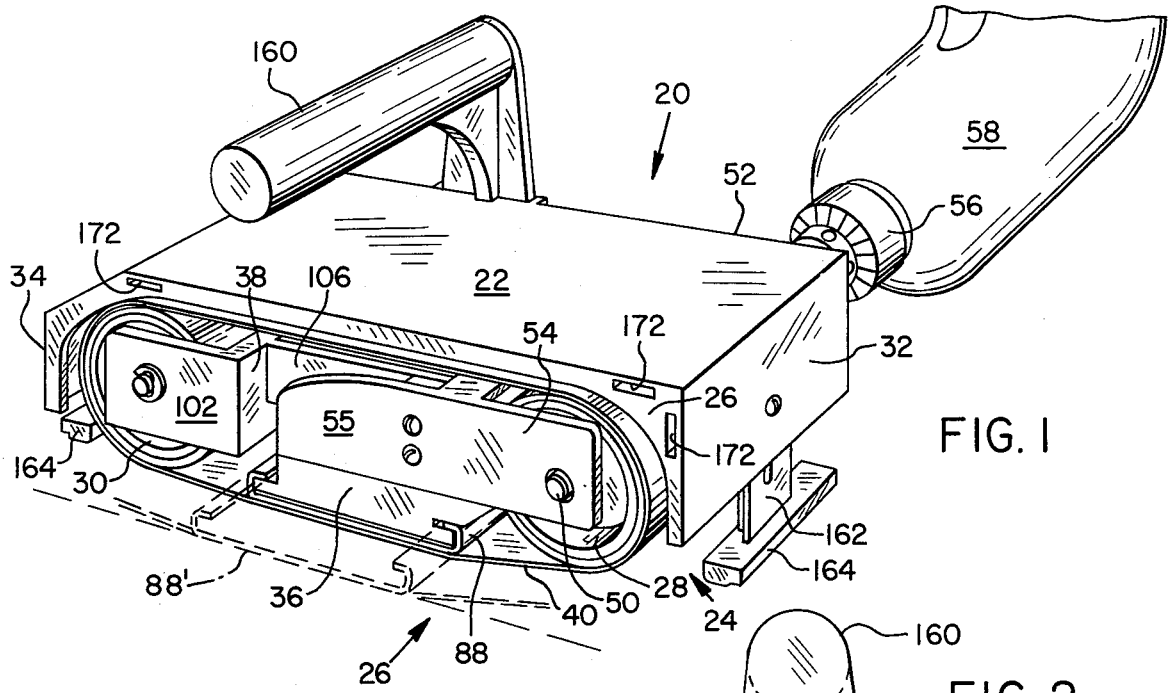
FIG. 1 is a perspective view of the sander accessory of the present invention coupled to a portable hand-held power drill.

Referring to FIGS. 1–5, the sander accessory of the present invention, denoted generally as 20, is seen to comprise an elongate body member 22 open at its bottom 24 and at one side 26, a drive roller 28 and idler roller 30 disposed within the body member 22 in spaced parallel relationship proximate opposite ends 32 and 34 thereof, a bearing plate assembly 36 mounted within the body member 22 intermediate the two rollers 28 and 30, and a yoke assembly 38 coupled to the bearing plate assembly 36 so as to support the idler roller 30; the drive roller 28 being fixed to a drive axle 50 that is journaled between the closed side wall 52 of the body member 22 and a rearwardly extending portion 54 of a support member 55 that is attached to both the body member 22 and the plate assembly 36. The drive axle 50 fixed to the drive roller 28 extends beyond the side 52 of the body member 22 a distance sufficient to permit its engagement by the chuck 56 of a portable hand-held power drill 58 such that operation of the drill 58 produces rotation of the roller 28 and movement of an endless sandpaper belt 40 looped around both rollers. Although shown in the figures as extending from the closed or right-hand side 52 of the body member 22, the drive axle 50 may be alternately oriented, by corresponding orientation of the drive roller 28, to extend from the open or left-hand side 26 of the body member 22 so as to permit the sander accessory to be operated by a left-handed as well as a right-handed person as described more fully below. The major components, and others, of the sander accessory 20 are preferably of rigid lightweight plastic material such as polycarbonate. Gussets and metal reinforcements, not all of which are indicated in the figures for clarity, are employed where necessary to provide the sander with the requisite strength characteristics.

Figure 4:
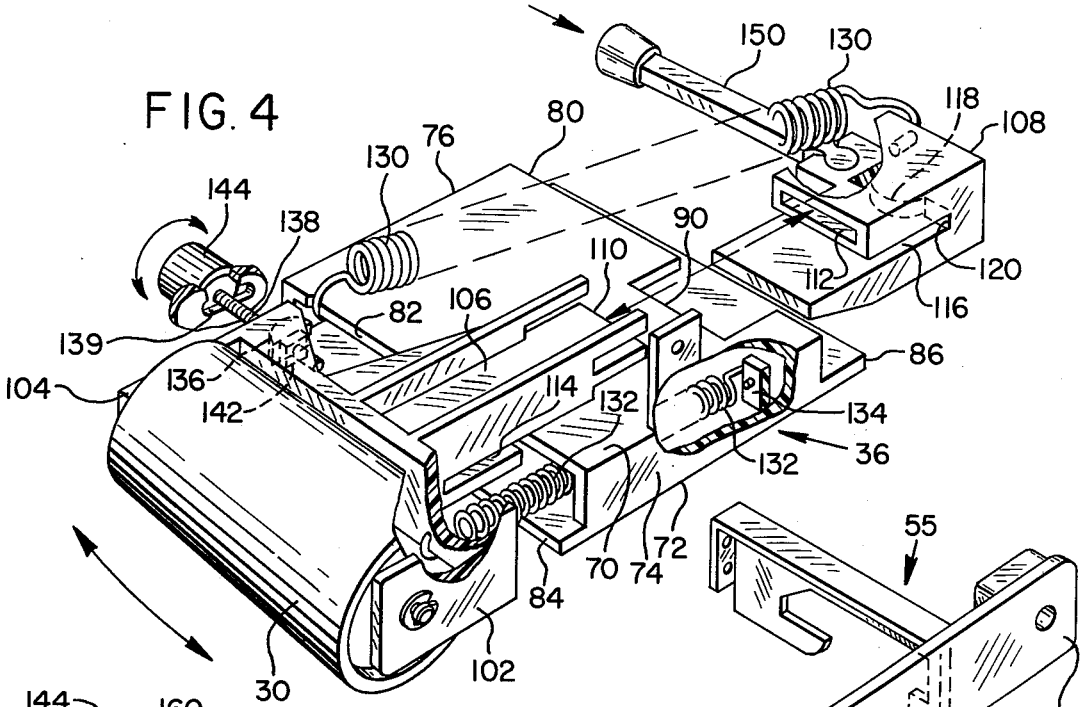
FIG. 4 is an exploded perspective view of the bearing plate assembly and yoke assembly components of the sander accessory of FIG. 1.

As seen in the figures, and especially in the exploded view of FIG. 4, the bearing plate assembly 36 of the sander accesssory 20 includes an upper plate member 70 spaced a short parallel distance above and connected to a lower plate member 72 by a pair of side members 74 and 76 to form a rigid box-like structure that is attached at its side 76 to the interior of the closed body member side wall 52 by any suitable means such as weldment or removable fasteners so as to extend across the open bottom 24 of the body member 22 as the lowermost extremity of the accessory. The other side 74 of the bearing plate assembly is attached to the support member 55 shown in detail in FIG. 4*a*. This support member 55 is also attached to the closed side wall 52 of the body member 22 and serves to support both the plate assembly 36 and the drive roller 28. Note that, as shown in FIG. 2, the lower edges 80 and 82 of the closed side wall 52 of the body member 22 are preferably angled upwardly toward the ends 32 and 34 of the body member to ensure that the bearing plate assembly 36 does indeed form the lowermost portion of the accessory.

Figure 2:
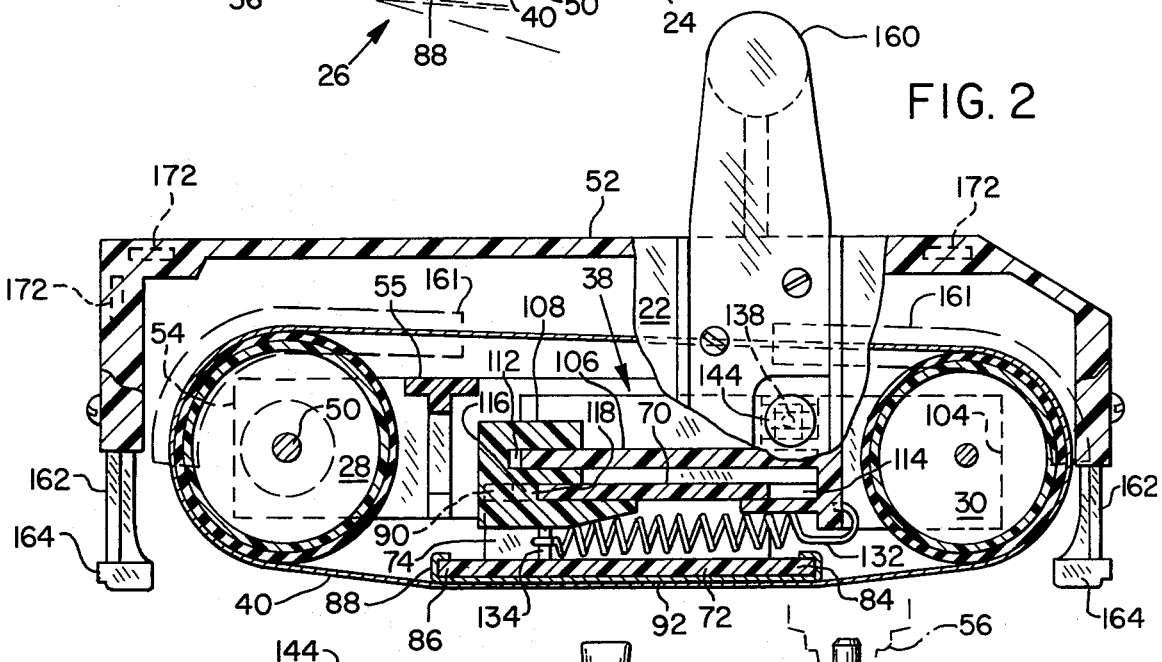
FIG. 2 is an elevation view of the sander accessory of FIG. 1 showing selected internal components in phantom.

The forward and rearward edges 84 and 86, respectively, of the lower plate member 72 extend a short distance beyond the corresponding edges of the upper plate member 70, as shown in FIGS. 1, 2 and 4 to accept and retain a metal shoe 88 having a substantially planar bearing surface 92 that is directed outwardly and away from the open bottom 24 of the body member 22. This bearing surface 92 acts as supportive backing for a portion of the sandpaper belt 40 looped around the two rollers 28 and 30. As shown in FIG. 1, the shoe 88 is mounted on the bearing plate assembly 36 so as to be laterally displaceable for reasons described more fully below. Also for reasons described more fully below, a notch 90 is formed, as shown in FIG. 4, in the rearward edge 80 of the upper plate member 70.

The yoke assembly 38 includes, as shown in the figures, a shank portion 100 attached to a pair of spaced prongs 102 and 104; the shank portion being separable into a forward section 106 and a rearward section 108, and the prongs 102 and 104 serving to mount the idler roller 30. As best seen in the exploded view of FIG. 4, the two sections 106 and 108 of the shank 100 are intercouplable by means of a tab 110 extending from one end of the forward section 106 so as to be insertable into a complementary shaped slot 112 formed in the rearward section 108. Each section of the shank 100 also includes a laterally extending slot 114 and 116, respectively, such that, when the sections are intercoupled, the slots 114 and 116 will engage the upper plate member 70 of the bearing plate assembly 36, captively securing the yoke assembly 38 thereto so as to permit its angular movement yet prevent its substantial vertical movement. Note that, when the two sections 106 and 108 of the shank 100 are intercoupled, the rearward section 108 slides into seating engagement with the earlier-mentioned notch 90 formed in the rear edge of the upper plate member 70. A small semicircular extension 118 of the rear wall 120 of the slot 116 formed in the rear section 108 of the shank 100 limits the forward motion of the yoke assembly 38 and also serves as a fulcrum point about which the yoke assembly may be rotated in a direction parallel to the plane of the upper plate member 70 and lateral to the body member 22.

Figure 3:
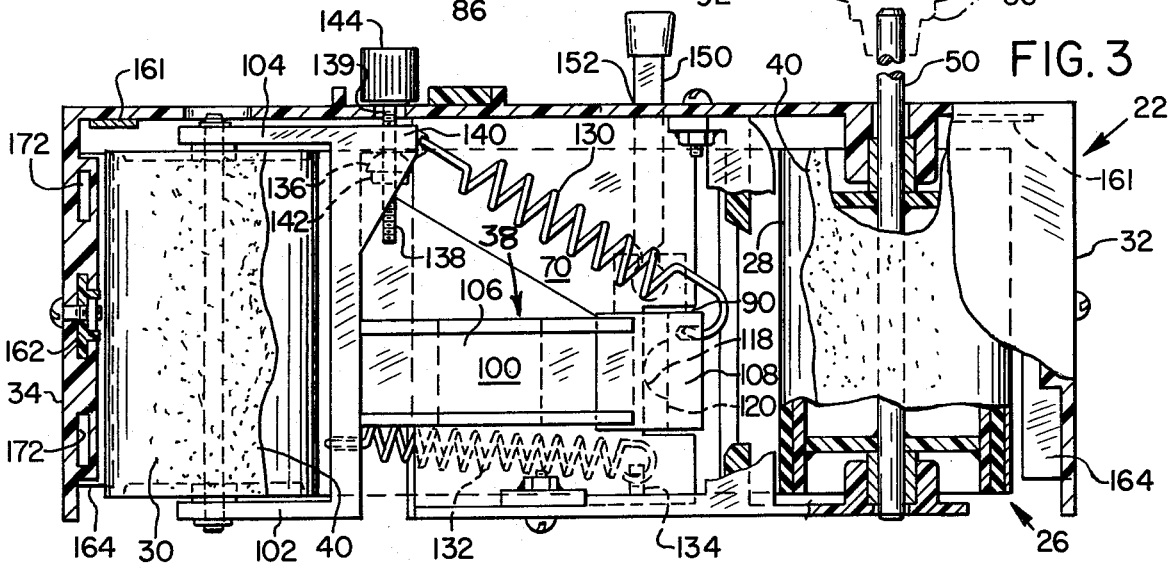
FIG. 3 is a partially sectioned plan view of the sander accessory of FIG. 1.

A bias spring 130 coupled between the rear section 108 of the shank portion 100 of the yoke assembly 38 and the leading edge 82 of the upper plate member 70, as best seen in FIGS. 3 and 4, serves to urge the rear section 108 of the shank 100 into seated fulcrumnal engagement with the notch 90 formed in the rear edge 80 of the upper plate member 70, and also to bias the yoke assembly 38 in a direction urging its prongs 102 and 104, and thereby the idler roller 30, away from the closed side 52 of the body member 22. A second bias spring 132 connected between the forward section 38 of the shank 100 and a tab 134 located rearwardly within the bearing plate assembly 36 operates, in cooperation with the first spring 130, to maintain the two sections 106 and 108 of the shank 100 in intercoupled engagement with the upper plate member 70, as well as add to the force tending to urge the prongs 102 and 104 away from the side wall 52 of the body member 22.

Figure 4A:
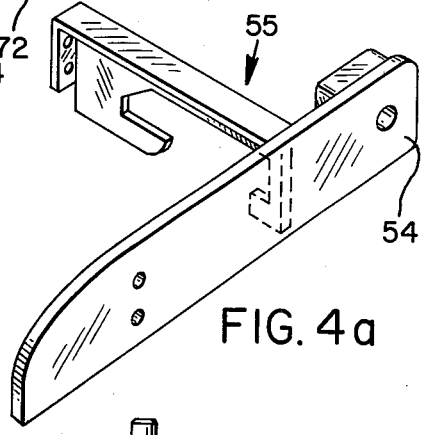
FIG. 4*a* is a perspective view of a component of the sander accessory of FIG. 1.
Figure 4B:
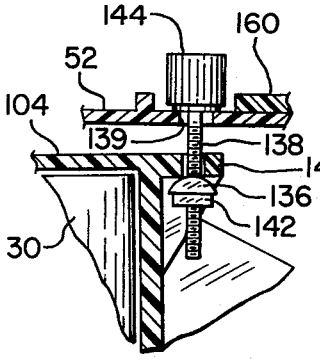
FIG. 4*b* is a sectional detail view of a portion of the sander accessory as shown in FIG. 3.

Rotational movement of the yoke assembly 38 under the urging of the two springs 130 and 132 is limited by a semi-cylindrical restraining member 136 coupled to the body member 22 via threaded rod 138 extending through a slot 139 formed in the closed side wall 52 and terminating in a knurled knob 144. A tab 140 extending rearwardly from one prong 104 of the yoke assembly 38 has a substantially planar surface 141 that contacts the semi-cylindrical surface of the restraining member 136 uniformly along a line parallel to its longitudinal axis. A nut 142 threaded onto the rod 138 to the rear of the semi-cylindrical member 136 and held captive by a pair of webs 143 reinforcing the tab 140 permits the angular movement or displacement of the yoke assembly 38 to be adjusted by adjustment of the rod; such adjustment being facilitated by the knob 144 attached thereto. The advantage of using a semi-cylindrical member 136 as the restraining means for controlling the angular displacement of the yoke assembly 38, rather than for example a flat-surfaced nut, is that a uniform line of contact is maintained between the semi-cylindrical member 136 and the tab 140 whether the yoke assembly 38 is in its centered position, as shown in FIG. 3, and an offset position, such as shown in FIG. 4*a*. This maintenance of a uniform line of contact enhances the accuracy and stability of the angular movement of the yoke assembly 38, and thereby the angular displacement of the idler roller 30 relative to the drive roller 28. Such accurate and stable adjustment is necessary to ensure proper tracking of the sandpaper belt 40 looped around the two rollers 28 and 30.

Figure 5:
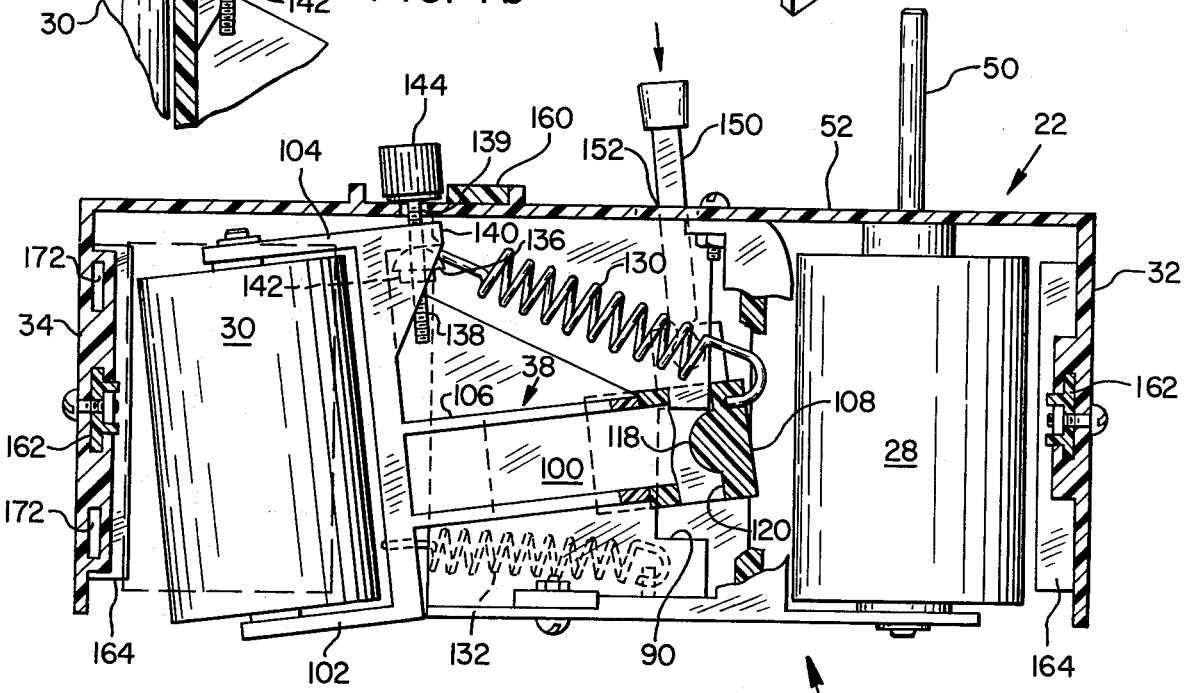
FIG. 5 is a partially sectioned plan view of the sanding accessory of FIG. 1 with its yoke assembly displaced rearwardly.

To facilitate the mounting of a sandpaper belt about the two rollers 28 and 30, the yoke assembly 38 is displaceable rearwardly, as shown in FIG. 5, so as to disengage the rear section 108 of the shank from the notch 90 formed in the rear edge 80 of the upper plate member 70 of the bearing plate assembly 36. This displacement is aided by the laterally directed force component of the bias springs 130 and 132 connected between the rear section 108 of the shank 100 and the bearing plate assembly 36. Once the yoke assembly 38 has been so displaced, the sandpaper belt may be readily fitted over the two rollers 28 and 30, and the yoke assembly 38 returned to its original position by pressing inwardly on a rod 150 coupled to the rear section 108 of the shank 100 and extending through an aperture 152 formed in the closed side wall 52 of the body member 22; such repositioning being encouraged by the forwardly directed force component of the bias spring 130.

In operation, with the chuck 56 of the power drill 58 coupled to its drive roller 28, the sander accessory 20 may be grasped in one hand by means of a handle member 160 attached as shown in FIG. 1 to the closed side wall 52 of the body member 22, and the drill 58 may be grasped in the other hand. The sander-accessory-and-drill combination may then be moved across a workpiece in a manner similar to that employed when operating a convention belt-type sander. Metal fenders 161 attached to the inner surface of the closed wall 52 of the body member 22 protect the wall from wear caused by contact with the moving belt 40. To facilitate sanding in corners between two mutually orthogonal workpieces, the metal shoe 88 may be extended laterally, as indicated in FIG. 1, and the yoke restraint 136 adjusted accordingly to position the belt to one side.

A laterally extending skid 162 mounted at each end of the body member 22 and adjustable so as to extend downwardly to a position equal to that of an imaginary plane containing the bearing surface 92 of the shoe 88 prevents the sander accessory from gouging or otherwise unevenly sanding a workpiece as the sander-accessory-and-drill combination is moved thereacross. The two skids 162 combine to provide pitch control of the sander accessory while their laterally extending foot portions 164 provide roll control.

Referring now to FIGS. 6–8, it is seen that the sander accessory 20 of the present invention may also be mounted on a work surface 166 with the bearing surface 92 of the shoe 88 oriented either horizontally or vertically. Mounting of the sander accessory to the work surface is accomplished via mounting tabs 170 that fit into slots 172 formed for that purpose about the upper and end surfaces of the body member 22. Note that the handle member 160 must be removed from the body member 22 before the sander accessory can be mounted in a horizontal position. Such movement of the handle member 160 is not necessary when mounting the body member in a vertical position. To increase the stability of the bearing plate assembly 36 when the sander accessory is mounted in a horizontal position, one of the skids 162 may be detached from its normal position at the end of the body member and attached, as shown in FIG. 7, by screws or other suitable fasteners to the support member 55 in a position proximate the side of the bearing plate assembly 36. A step 174 formed along one side of the foot 164 of the repositioned skid 162 mates with a ledge 176 formed along the underside of the top of the body member 22 to ensure secure engagement of the skid.

When the sander accessory 20 is mounted on a work surface in either its horizontal or vertical position, the power drill coupled to the drive roller 28 should also be fastened to the work surface by a strap 178 or other suitable means. As before, operation of the sander accessory 20 when mounted on a work surface is accomplished by operation of the drill 58.

The terms and expressions which have been employed in the foregoing abstract and specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A belt-type sanding device comprising:

(a) an elongate body member having an open bottom, a closed side, an open side and two longitudinally opposed ends;

(b) a substantially cylindrical drive roller mounted proximate one end of said body member so as to extend laterally across said open bottom thereof, said drive roller being rotatable on its axis;

(c) drive means coupled to said drive roller for imparting rotational motion thereto about said axis;

(d) a bearing plate assembly including upper and lower plate members arranged in spaced substantially parallel relationship to one another and attached to said closed side of said body member extending across said open bottom thereof toward said open side, said lower plate member including a substantially planar bearing surface directed outwardly from said open bottom of said body member;

(e) a yoke member having an elongate shank portion having first and second sections extending longitudinally in said body member, said shank portion including means for coupling said yoke member to said upper plate member and for preventing substantial vertical displacement of said yoke member relative to said bearing plate assembly including engaging means associated with each of said first and second sections for engaging said upper plate member of said bearing plate assembly and bias means connected between each of said sections and said plate assembly for maintaining said sections intercoupled;

(f) a substantially cylindrical idler roller mounted on said yoke assembly proximate the other end of said body member so as to extend laterally across said open bottom thereof, said idler roller being rotatable about its axis; and (g) said drive roller, bearing plate assembly and idler roller being oriented in said body member such that an endless belt of sandpaper may be looped therearound with a portion of said belt in contact with said bearing surface and such that rotation of said drive roller causes movement of said belt across said surface.

2. The sanding device of claim 1 wherein said engaging means associated with each section of said shank portion of said yoke member comprises means defining a laterally extending slot in each said section, each said slot being oriented in a respective section such that, when said sections are intercoupled, a portion of said upper plate member of said bearing plate assembly is housed within each slot.

3. A belt-type sanding device comprising:

(a) an elongate body member having an open bottom, a closed side and two longitudinally opposed ends;

(b) a substantially cylindrical drive roller mounted proximate one end of said body member so as to extend laterally across said open bottom of said body member, said drive roller being rotatable about its central axis;

(c) drive means coupled to said drive roller for imparting rotational motion thereto about said axis;

(d) a bearing plate assembly having an upper plate member mounted on said closed side of said body member such as to extend laterally across said open bottom intermediate said opposing ends of said body member including means defining an engagement surface on said bearing plate assembly facing longitdinally of said body member;

(e) a yoke member including an elongate shank portion movably mounted on said bearing plate assembly such as to extend longitudinally relative to said opposing ends and pivot laterally relative to said closed side;

(f) a substantially cylindrical idler roller mounted on said yoke member proximate one end thereof opposite said drive roller so as to extend laterally across said open bottom of said body member, said idler roller being in spaced relationship with said drive roller and said bearing plate assembly such that an endless belt of sandpaper may be looped around said rollers;

(g) said yoke member comprising a forward section housing said idler roller, a rearward section adjacent said drive roller, coupling means associated with said sections for engaging said upper plate member of said bearing plate assembly, bias means connected between each of said forward and rearward sections and said bearing plate assembly for maintaining said sections intercoupled, and an extension member mounted on said rearward section of said yoke member having means defining a laterally extending, semicircular fulcrumal surface thereon facing said idler roller and said engagement surface and spaced a predetermined distance from said idler roller; and (h) tensioning means for separating said rollers by a distance sufficient to place said belt in tension including bias means for urging said fulcrumal surface against said engagement surface so as to maintain said belt in said tension state.

4. The sanding device of claim 3 including slot means formed longitudinally in said yoke member for movably coupling said yoke member with said upper plate member of said bearing plate assembly permitting longitudinal movement of said yoke member in a direction toward said drive roller and laterally away from said closed side of said body member to an offset position for releasing said belt from tension, and including means cooperatively associated with said yoke member for urging said idler roller toward said offset position.

5. The sanding device of claim 3 including means for moving said yoke member so as to achieve lateral displacement of the end of said shank portion located opposite said idler roller away from said closed side, said bias means being responsive to said lateral displacement such as to urge said fulcrumal surface against said engagement surface thereby retensioning said belt.

6. The sanding device of claim 3 wherein said bearing plate assembly includes a metal shoe slidably mounted thereon intermediate said bearing plate assembly and said belt so as to be laterally displaceable from said closed side, and wherein said sanding device further comprises adjustable means for positioning said belt relative to said laterally displaced shoe and skid member means movably mounted respectively at said opposed ends of said body member extending downwardly therefrom sufficiently to engage a sanding surface for providing lateral support for said sanding device when said device is engaging a sanding surface with said shoe laterally displaced from said closed side.

* * * * *